US011305446B1

(12) United States Patent
Hirneise

(10) Patent No.: US 11,305,446 B1
(45) Date of Patent: Apr. 19, 2022

(54) TUBE END TAPERING METHOD AND DEVICE

(71) Applicant: Paul Hirneise, Gainesville, FL (US)

(72) Inventor: Paul Hirneise, Gainesville, FL (US)

( * ) Notice: Subject to any disclaimer, the term of this patent is extended or adjusted under 35 U.S.C. 154(b) by 0 days.

(21) Appl. No.: 17/356,685

(22) Filed: Jun. 24, 2021

(51) Int. Cl.

| | |
|---|---|
| ***B26D 7/01*** | (2006.01) |
| ***B26D 3/16*** | (2006.01) |
| ***B26D 1/153*** | (2006.01) |
| ***B26D 7/26*** | (2006.01) |
| ***B26D 7/00*** | (2006.01) |
| *B26D 3/02* | (2006.01) |

(52) U.S. Cl.
CPC ..... *B26D 3/162* (2013.01); *B26D 1/153* (2013.01); *B26D 3/164* (2013.01); *B26D 7/0006* (2013.01); *B26D 7/01* (2013.01); *B26D 7/2614* (2013.01); *B26D 3/02* (2013.01)

(58) Field of Classification Search
CPC ..... B26D 3/162; B26D 3/164; B26D 1/153; B26D 7/0006; B26D 7/01; B26D 7/2614; B26D 3/02
USPC ..... 30/92
See application file for complete search history.

(56) References Cited

U.S. PATENT DOCUMENTS

| | | | | |
|---|---|---|---|---|
| 3,811,347 | A * | 5/1974 | Heckhausen | B26D 3/162 83/861 |
| 7,992,473 | B2 * | 8/2011 | Marple | B23K 26/103 82/113 |
| 10,569,436 | B2 * | 2/2020 | Lo | B26D 7/02 |
| 2017/0015013 | A1 * | 1/2017 | Briones | B26D 5/08 |

* cited by examiner

*Primary Examiner* — Omar Flores Sanchez
(74) *Attorney, Agent, or Firm* — Sven W Hanson

(57) ABSTRACT

Devices and methods are provided for cutting or forming tapered surfaces on the end portions of tube or pipe lengths prior to forming joints in adjoining lengths. A device body includes multiple guide surfaces, each having distinct size and shape to engage with an open end of a one of a multiple of tube of predetermined diameters. In intended use, a powered cutting device is rotated about the end of stationary tube or pipe.

2 Claims, 4 Drawing Sheets

TUBE END TAPERING METHOD AND DEVICE

BACKGROUND

The invention pertains to devices and methods for cutting or forming circumferential tapered surfaces on the end portions of tube or pipe lengths prior to forming joints in adjoining lengths. Conventional liquid transport systems fabricated of multiple common lengths of tube are often joined in a manner that require that one end of each tube be tapered on the outside surface adjacent the tube end. One end of a first tube includes an outer a tapered, circumferential surface; that is the tube end is tapered to a reduced thickness toward the end. The tapering and reduced thickness serves to assist in centering the tube end as it enters a second tube having a "bell end". Centering is important to assure that the first tube enters and passes through a flexible seal within the bell end without damage to the seal or gasket. While such tubes are preformed with an initial bell end, the tubes are often cut to length in the field, during use, and the tapering must then be field cut in conventional operations. This operations are commonly accomplished by hand with irregular results and frequent damage to gaskets. Further, at any particular system fabrication site, tubes of multiple different diameters are often employed. What is needed is a method and device for quickly repeatedly cutting a tapered end on bell end tubes of various different diameters.

SUMMARY OF THE INVENTION

The invention includes method and devices for cutting tapered surfaces on the outside end surfaces of tubes and pipes, in particular of large diameter. A device body includes multiple guide surfaces, each having distinct size and shape to engage with an open end of a respective one of a multiple of predetermined diameter tube. While engaged with the open end of the tube, the device may be rotated in use about an axis parallel to the longitudinal axis of the tube. A cutting device is located mounted on the device body and oriented to bear on an outer surface of the engaged tube as the device body and cutting device together are rotated to symmetrically cut or form the outer tube surface. A drive device, such as an electrically powered motor is secured to the device body and connected to the cutting device to enable its cutting function. Other aspects of the invention will be made clear from the following discussion of embodiments of the invention and the accompanying figures.

DETAILS OF EMBODIMENTS OF THE INVENTION

Figure 1:
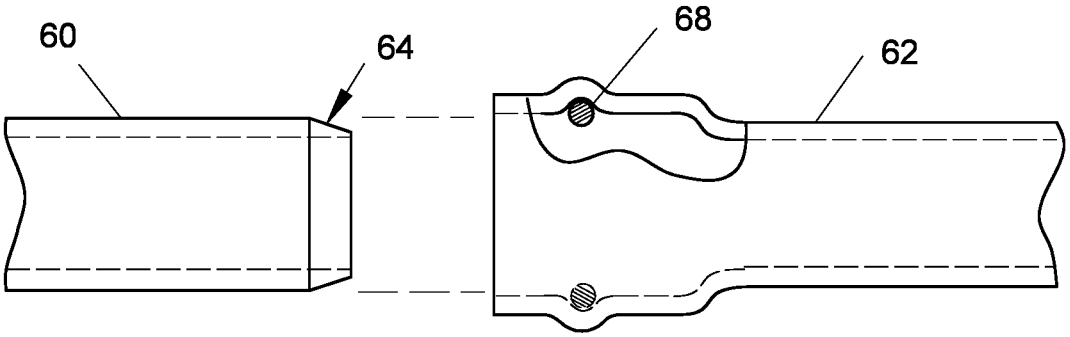
Fig. 1 Prior Art
FIG. 1 illustrates an application of the invention to a prior art tube fitting.

Conventional liquid transport systems fabricated of multiple common lengths of tube are often joined in a manner that require that one end of each tube be tapered on the outside surface adjacent the tube end. FIG. 1 illustrates two prior art tube lengths to be joined, separated for illustration. The figure is provided for understanding of the purpose and function of the invention. In the figure, at one end of a first tube 60, a tapered surface 64 has been formed at an angle relative to the longitudinal axis of the tube. The tapered surface 64 is symmetric about the longitudinal axis of the tube. The angle of the tapered surface 64 serves to assist in centering the tube end as it enters a second "bell end" tube 62. Centering is important to assure that the first tube 60 enters and passes through, without damage, the typical seal or gasket 68 located within the bell end. While the second tube 62 bell end is typically formed with the tube itself, often tubes are cut to length in the field, during use, and the tapered surface 64 must then be field cut in conventional operations.

Figure 2:
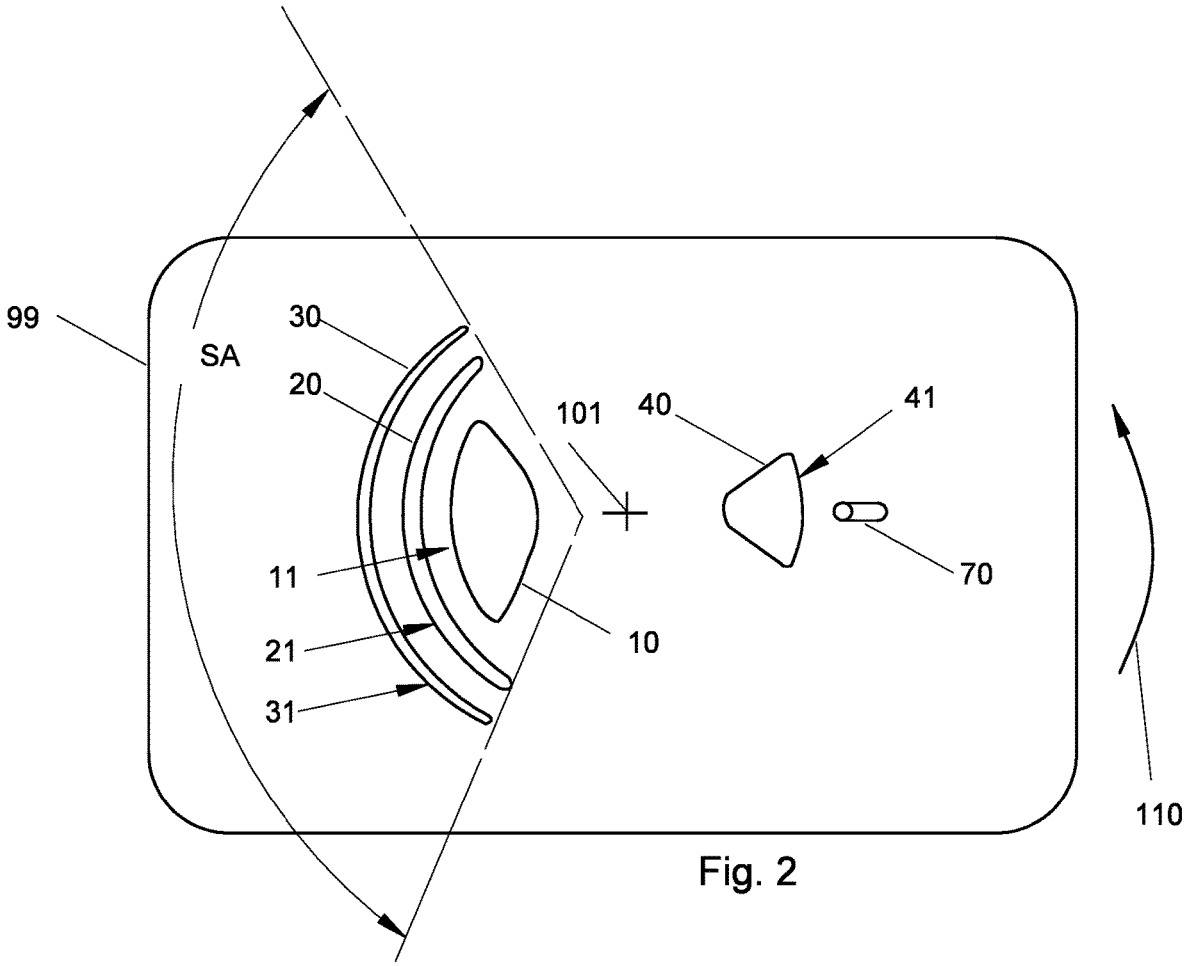
FIG. 2 is a plan view of one configuration of a device according to the invention.
Figure 3:
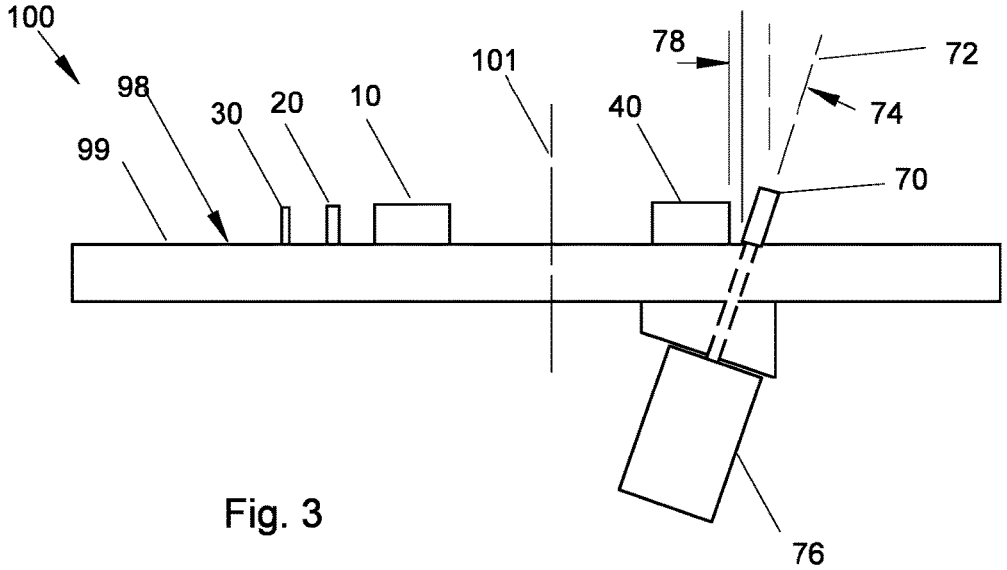
FIG. 3 is a side view of the device of FIG. 2.

The following pertains to the accompanying FIGS. 2 to 4, all of which consider the same inventive device. Herein, the words, "tube" and 'pipe" are intended to indicate and encompass a range of objects typically elongated, with hollow circular cross-section. More particularly, the invention regards tube and pipe typically used for carrying water or waste water such as potable water supply lines for residences or business buildings. However, the invention may be applied equally in other similar circumstances. While in practice the invention considers tube of plastic materials, such as PVC that are commonly used for potable water tube and pipe and the like, but the invention is not limited by the tube material. For convenience, the term "tube" will be used herein to indicate generally all the above.

The present inventive device 100 includes a rigid device body 99 which may have any of a variety of general shapes and sizes depending upon the circumstance of use. The body 99 has an upper surface 98 from which extend a first tube guide 10, a second tube guide 20 and a third tube guide 30. These elements maybe formed integral with the body 99 or may be separate structures then permanently secured to or affixed to the upper surface 98 and body 99. The number of tube guides is not critical for function. However, the invention provides a device uniquely combining multiple tube guides to enable working multiple different tubes with a single device to great advantage. The maximum number of different tube guides (different tube sizes) is somewhat limited by the particular materials and manner of the construction of the body 99.

Each tube guide 10, 20, 30 includes a respective tube guide surface 11, 21, 31, each tube guide surface 11, 21, 31 has constant curvature (forms a partial circle) in a plane parallel to the upper surface 98 adjacent the respective tube guide. That is, the upper surface 98 may have an irregular shape or local orientation at portions distant from the guides 10, 20, 30 and tube guide surface 11, 21, 31. However it is critical that immediately adjacent each tube guide surface 11, 21, 31 the upper surface 98 must be effectively perpendicular to the tube guide surfaces 11, 21, 31. It will be clear that each tube guide surface 11, 21, 31 and also the respective adjacent portion of the upper surface 98 may consist of multiple separated portions and still constitute and function as the indicated surface.

The body 99 includes a common guide 40 that extends from the upper surface 98 and generally parallel to, and in the same direction as, the tube guides 10, 20, 30. The common guide 40 includes a common guide surface 41 that is perpendicular to the upper surface 98 in the same manner as the tube guide surfaces.

Figure 4A:
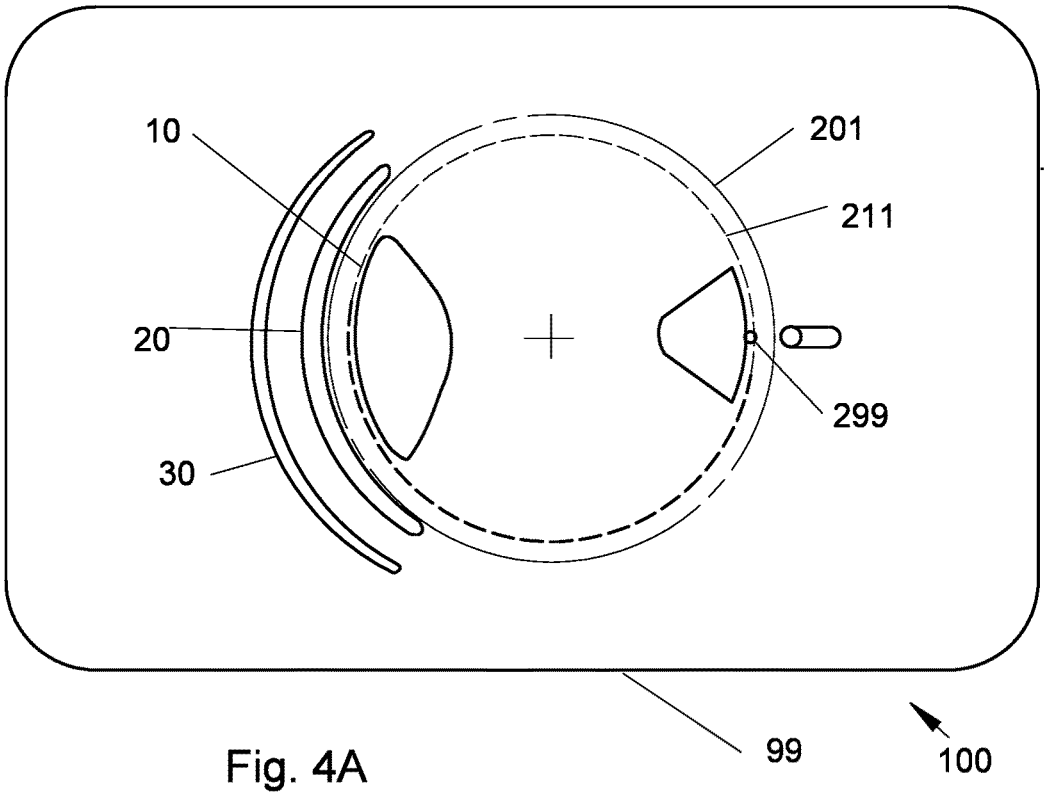
FIGS. 4A, 4B, 4C are plan views of the device of FIG. 2 illustrating alternative engagements of various tube ends on the device in use.
Figure 4B:
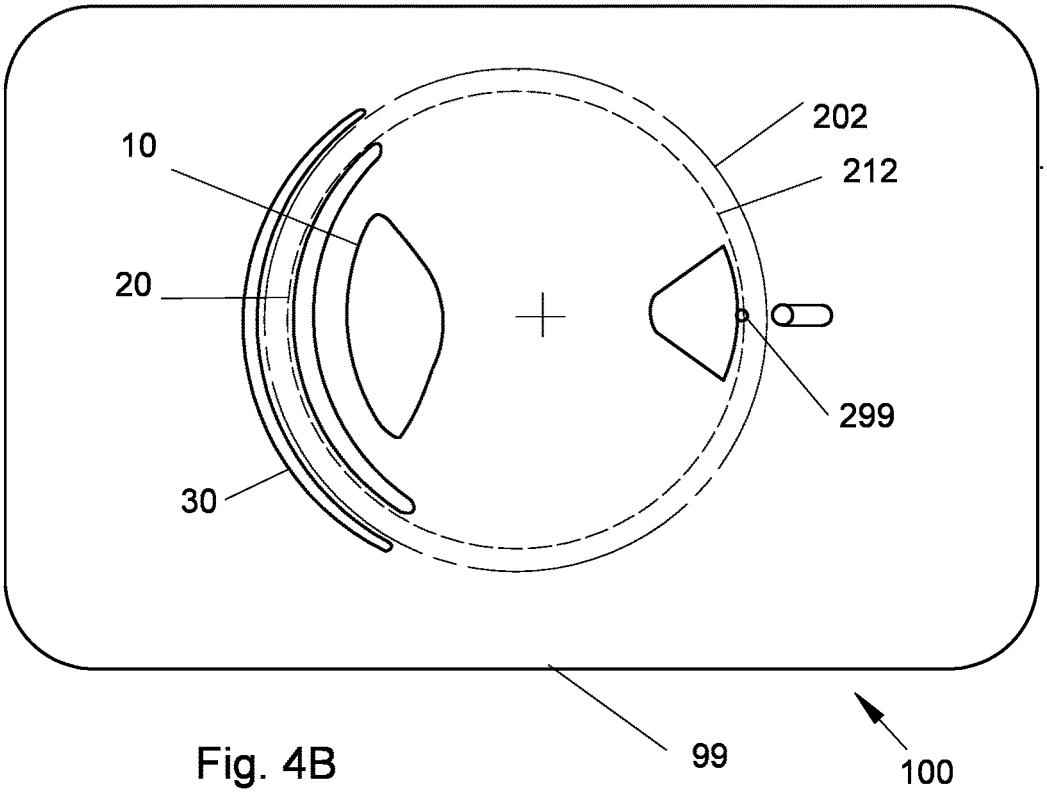
Figure 4C:
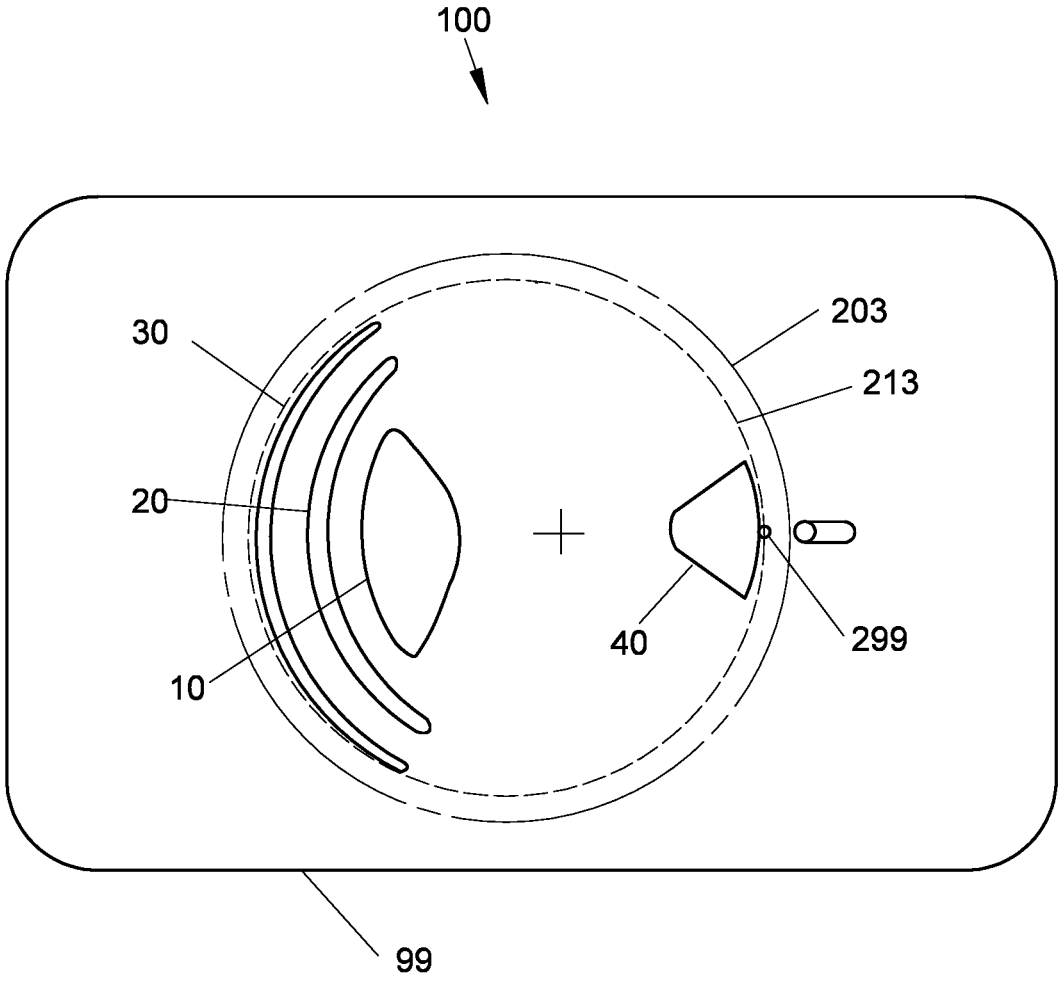

FIGS. 4A, 4B, 4C illustrate various different engagements of the device 100 with conventional tubes of various different diameters. Multiple upper surface path portions 201, 202, 203 define the engaging contact area adjacent the tube guides 10, 20, 30 for the end surface the engaged tube during intended use of the device 100. These above elements of the body 99 are together generally designed to engage, alternatively, any of multiple different tubes of distinct predetermined inside diameters.

The path portions 201, 202, 203 are each defined by an continuous circular unobstructed area on the upper surface 98 with a respective circular inner edge 211, 212, 213 and a respective radial dimension approximating that of a respective predetermined tube to be worked. Each path portion 201, 202, 203 also is planar and perpendicular to the tube guide surfaces 11, 21, 31 as discussed.

Each tube guide 10, 20, 30 is sized and shaped, and each respective tube guide surface 11, 21, 31 has an associated curvature matching that of the respective inner edge 211, 212, 213, that together enable certain and steady engagement, in use, with a respective tube to be worked.

In use, a tube to which a surface is to be cut engages both of one tube guide surface 11, 21, 31, and the common guide surface 41, while the tube is maintained parallel to a operational axis of rotation 101 of the device 100 which is perpendicular to the upper surface 98. In this way also the tube inside surface is maintained parallel to the tube guide surfaces 11, 21, 31.

The location of each tube guide surface 11, 21, 31 and the common guide surface 41 is such that the common guide surface 41 coincides with all the inner edges 211, 212, 213 at a common point 299. That is, both one of tube guide surfaces 11, 21, 31 and the common guide surface 41 coincides with one of the inner edges 211, 212, 213.

The specific curvature, respecting each guide surface, may be adjusted in design to allow, in use, rotation of a tube about an associated tube guide surface and the common guide surface. That is, the curvature of the tube guide surfaces 11, 21, 31 and the common guide surface 41 curvature may be adjusted to provide a sliding fit or accommodate variations in the diameters of the associated tubes.

The common guide surface 41 has a constant curvature (in a plane parallel the upper surface 98) that is equal to the smallest of the tube guide surface curvatures. This is to enable sure engagement of the tube with each the respective tube guide surface 11, 21, 31 during use. The common guide surface 41 curvature may also vary slightly over its area.

Herein, the term "coincide" and its forms is used to indicate that referenced surfaces and circular paths are concentric and have parallel tangents in a common plane.

Also to ensure engagement during use, each tube guide surface 11, 21, 31 should extend, circumferentially, through a surface angle SA of at least 90 degrees and most preferably in the range of 180 to 220 degrees for ease of use and sure engagement. Smaller angles induce jamming of the tube against the guide surface upon rotation and hence failure to rotate as needed. Larger surface angles SA may be possible but larger surface angles SA approaching 360 are not feasible due to spatial interference of the multiple tube guide structure in the proximity of the common guide 40. In FIG. 2, the surface angle SA is illustrated for only one of the tube guides and respective surface angles SA for each tube guide may be distinct and different from other tube guides.

It will be clear that the respective center axes of symmetry of the three paths 201, 202, 203 are distinct and separated and all pass through a common straight line in the plane of the upper surface 98 and all are mutually parallel.

It is essential, and presumed, that in use, a tube to be worked by the device 100 will previously been formed to have an end surface that is substantially flat and perpendicular to the longitudinal axis of the tube, which axis is also presumed parallel to the inside surface of the tube.

The device 100 also includes a cutting device 70 in the form of a rotary milling blade or rotary grinding tool. The cutting device 70 extends along an axis 72 from the upper surface 98 and adjacent to and separated from the common guide surface 41. The cutting device 70 is oriented at an cutting angle 74 with respective to, and located a cutting distance 78 from, the common guide surface 41 such as to engage and work a tube that has been engaged with the device 100 as described. The cutting distance 78, being the smallest dimension between the common guide surface 41 and the cutting device 70, is somewhat less than the wall thickness of the tube to be worked. Preferably, the device 100 incorporates mechanisms and methods for adjusting the cutting distance 78 to accommodate differences in tube wall thickness between multiple different tubes. This can be accomplished through adjustment of the mounting of the cutting device 70 or its driver.

In many applications the effective cutting angle 74 will be in the range of 3 to 30 degrees, although operation of the inventive device is not limited to that range. Both the cutting angle 74 and the cutting distance 78 of the cutting device 70 from the common guide surface 41 may be selected and depend on the particular application.

The device 100 includes a drive device 76, such as a electrically powered motor, or compressed air rotary drive. The drive device 76 is preferably removably secured to the body 99 and is connected to the cutting device 70 to provide cutting power and motion to the cutting device 70. In certain preferred embodiments, the drive device 74 and cutting device 70 are provided by a conventional hand-held electrical router device with a rotary cutting tool.

In preferred operation of the invention, a tube is engaged with the device 100 as described above. The cutting device 70 is driven by the drive device 76 to enable cutting of the tube material. At the same time, the body 99 is rotated in a plane perpendicular to the operational axis 101 while the tube is maintained relatively stationary such that the device 99 and the cutting device 70 are rotated together fully around the end of the tube as indicated by the movement arrow 110. In this manner, the cutting device 70 is applied to the tube end to cut or form a surface on the tube in an axially symmetric form.

In alternative configurations, the tube guides 10, 20, 30 may each or all include additional guide elements to incidentally assist the movement of a tube into the engaged condition described above.

In further alternative configurations, the body may include incidental features for convenience or safety, such as, for example, handgrips. In yet further configurations, the device is adapted to accept and secure one or more conventional electric handheld router devices that are designed to power rotating cutting blades, the two providing a drive device and cutting device as described.

As described above, each guide surface may consist of multiple portions. In an alternative configuration, each tube guide consists of two or more mutually spaced tube guide portions located above the upper surface 98, each tube guide portion having a respective tube guide surface portion. The tube guide portions are together located and aligned such that their collective tube guide surface portions coincide with a common path portion 201, 202, 203. The tube guide portions and respective tube guide surface portions are configured to together engage, in use, with a tube end in the same manner as described above. In this manner, each tube guide 10, 20, 30 is provided by multiple portions and each tube guide surface 11, 21, 31 is provided by multiple portions.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to elements in the singular, for example, using the articles "a," "an," "the" or "said," is not to be construed as limiting the element to the singular.

The invention claimed is:

1. A device for cutting a surface on an end portion of a tube, comprising:

a device body having an upper surface;

a multiple of tube guides, each extending from the upper surface, each tube guide having a respective tube guide surface, each respective tube guide surface having a curvature;

the upper surface including multiple path portions, each path portion having a respective inner edge, the inner edge being circular and having a curvature equal the curvature of one respective tube guide surface, the inner edge coinciding with the tube guide surface;

a shared guide extending from the upper surface and having a shared common guide surface;

the multiple tube guides and the shared guide all located on the body such that the shared guide surface coincides with all the inner edges;

a cutting tool extending from the upper surface adjacent the shared guide surface; and a cutting tool driver secured to the body and configured to power the cutting tool in a cutting action.

2. A device for cutting a surface on an end portion of a tube, comprising:

a device body having:

multiple tube guide surfaces, each tube guide surface having a unique curvature, multiple path portions, each path portion having a circular inner edge, each inner edge having a curvature matching the curvature of one associated tube guide surface, each inner edge coinciding with the associated tube guide surface, and a shared guide surface, the shared guide surface coinciding with all the inner edges; and a powered cutting device secured to the device body and extending from the upper surface adjacent the shared guide surface.

* * * * *